US009359555B2

(12) United States Patent
Bhirud

(10) Patent No.: US 9,359,555 B2
(45) **Date of Patent: *Jun. 7, 2016**

(54) DELAYED COKER FEED HEATER ON-LINE STEAM-CHEMICAL DECOKING METHOD

(71) Applicant: SBT TECHNOLOGY, INC., Houston, TX (US)

(72) Inventor: Vasant Lotu Bhirud, Katy, TX (US)

(73) Assignee: SBT TECHNOLOGY, INC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/848,326

(22) Filed: Sep. 8, 2015

(65) Prior Publication Data

US 2016/0102253 A1 Apr. 14, 2016

Related U.S. Application Data

(63) Continuation-in-part of application No. 13/615,554, filed on Sep. 13, 2012, now Pat. No. 9,127,211.

(60) Provisional application No. 62/109,047, filed on Jan. 28, 2015.

(51) Int. Cl.

| | |
|---|---|
| ***C10B 43/08*** | (2006.01) |
| ***B08B 3/08*** | (2006.01) |
| ***C11D 7/06*** | (2006.01) |
| ***C11D 7/12*** | (2006.01) |

(52) U.S. Cl.
CPC . *C10B 43/08* (2013.01); *B08B 3/08* (2013.01); *C11D 7/06* (2013.01); *C11D 7/12* (2013.01)

(58) Field of Classification Search
None
See application file for complete search history.

(56) References Cited

U.S. PATENT DOCUMENTS

| | | | | |
|---|---|---|---|---|
| 2,893,941 | A * | 7/1959 | Kohfeldt | C10G 9/16 314/39 |
| 3,617,479 | A * | 11/1971 | King, Jr. | C07C 4/04 208/48 AA |
| 5,593,568 | A * | 1/1997 | Lemke | C10G 9/16 208/47 |
| 6,772,771 | B2 * | 8/2004 | Cai | C10G 9/16 134/2 |

* cited by examiner

*Primary Examiner* — Nicole Blan
(74) *Attorney, Agent, or Firm* — Triantaphyllis Law Firm

(57) ABSTRACT

A process for decoking of delayed coker feed heater pass is disclosed. A chemical mixture containing a metal hydroxide and a metal carbonate is combined with steam to decoke the delayed coker feed heater pass.

13 Claims, 1 Drawing Sheet

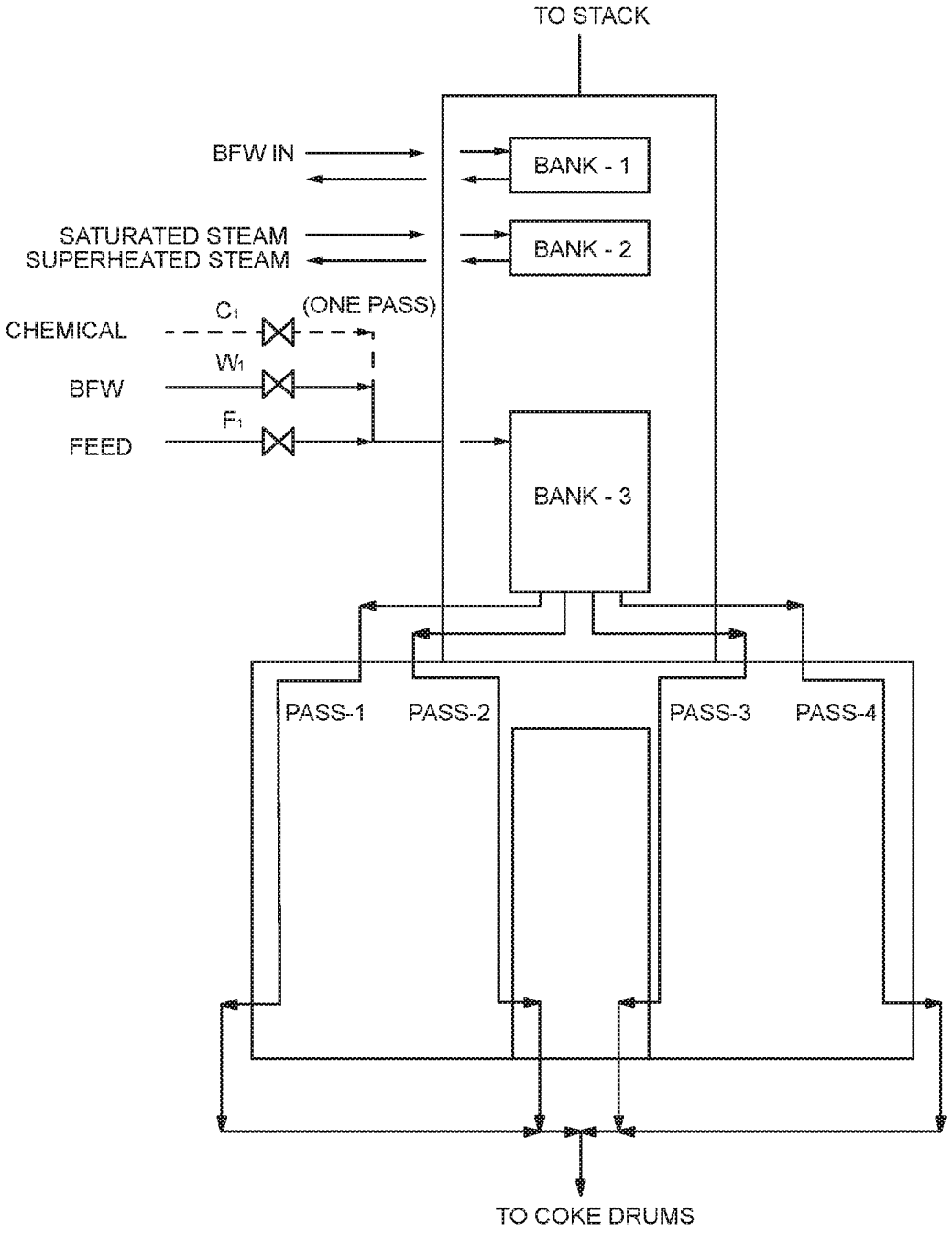
TO STACK
BFW IN
BANK - 1
SATURATED STEAM
SUPERHEATED STEAM
BANK - 2
CHEMICAL
C1
(ONE PASS)
BFW
W1
FEED
F1
BANK - 3
PASS-1
PASS-2
PASS-3
PASS-4
TO COKE DRUMS

DELAYED COKER FEED HEATER ON-LINE STEAM-CHEMICAL DECOKING METHOD

RELATED PRIORITY DATE APPLICATION

This application claims the benefit under 35 U.S.C. 119(e) of the U.S. provisional application No. 62/109,047 filed on Jan. 28, 2015.

RELATED APPLICATIONS

This application is a continuation in part application of U.S. application Ser. No. 13/615,554, filed Sep. 13, 2012, entitled "Ethylene Furnace Decoking Method" which claims the benefit under 35 U.S.C. 119(e) of the U.S. provisional application No. 61/533,812 filed on Sep. 13, 2011.

TECHNICAL FIELD OF THE INVENTION

The present invention relates to the field of delayed coker feed heaters and, more particularly, to the field of using chemicals to help steam decoking of the feed heater without the use of air. The decoking process is controlled by employing predetermined flow rates of steam and chemical mixture at predetermined radiant coil outlet temperature. This methodology eliminates the need of desulfiding radiant coils after steam-air decoking. The chemical mixture used in this invention is an aqueous solution of potassium hydroxide (KOH) and potassium carbonate (K2CO3).

BACKGROUND OF THE INVENTION

Delayed Coking is a refinery process extremely important to convert petroleum residue or often called "bottom of the barrel" (usually made up of bottoms from atmospheric and vacuum distillation of crude oil) to important transportation fuels like gasoline and diesel. If unconverted, residue would be difficult to dispose off as fuel oil as it is too heavy. Delayed coking is important to improve economics of a refinery as it converts low value residue to high value transportation fuels. Delayed Coking involves thermal cracking where petroleum residue is converted to lighter products leaving behind a solid carbon product called "petroleum coke". Thermal cracking occurs in a fired heater with horizontal tubes where residue is heated to predetermined temperature of about 925 to 950° F. Heated residue from the heater is sent to "Coke Drum" where it resides for hours and slowly converts residue to lighter products leaving "petroleum coke" in the drum. As complete coking takes place in the "Coke Drum" the process is termed Delayed Coking process. Three types of petroleum coke: sponge, shot and needle coke can be produced in delayed coking depending on the feed properties and the heater outlet temperature. Petroleum coke can be burned as fuel or converted to higher quality coke by calcining (heating to very high temperatures). Calcined coke is used in aluminum, chemical or steel industries. Calcined coke can be gasified to produce feedstock for petrochemical industry.

The feed heater is the heart of the Delayed Coking process. All heat is supplied in the heater tubes. The heater outlet temperature is typically about 925 to 950° F. at outlet pressure of about 40 to 60 psig.

As the technology evolved over years, latest heaters have two or four passes. Tubes are mounted horizontally on the side. Tubes are very long ranging from 2000' to 4000' depending on the design and are usually made of 9% chrome alloy. Burners are located on the floor of the heater and are fired upward. The burners of each heater box are controlled by the temperature of tube three or four back from the last tube to avoid fouling of thermocouples by coke. The heater is designed to have radiant section heat the feed and convection section to recover heat either with steam generation or other oil heating. Elliot (1996) states that the heater tubes be designed for an average radiant heat flux rate below 9000 Btu/hr-ft$^2$ with mass velocity of 400 lb/sec-ft$^2$.

As coke is formed on the heater tubes, heat transfer through coke to process fluid (in this case residue) decreases and heater outlet temperature begins to decrease below design temperature (between 925 to 950° F.). To maintain constant heater outlet temperature firing has to be increased, which raises the outer tube metal wall temperature. Ultimately coke thickness is so high that the outer tube metal wall temperature will reach its mechanical limit and then heater needs to be decoked. For 9% chrome alloy tubes, maximum tube metal temperature (max TMT) allowed is 1250° F. At the start of heater operation the tube metal temperature could be of the order of 1000° F. The time passed from start of heater operation (also called SOR) to end of heater operation (also called EOR) is termed heater run length. Heater run length could of the order of months depending on operating temperature and feed properties.

In the Delayed Coking process decoking is done by three methods: 1) Steam Spalling 2) Steam-Air decoking and 3) Hydraulic pigging.

Steam Spalling is done on-line by replacing residue in one of the passes with steam (in the form of boiler feed water). In on-line steam spalling, steam is heated to high temperature (about 1200° F.) and tubes are held there for predetermined period and then cooling the tubes by reduced firing to snap (or spall) the coke off the inside metal walls of the tube. Spalling occurs because tube metal walls contract more than coke resulting in stresses on coke which fracture the coke into pieces (called spalling). The steam and spalled coke go into coke drum. Steam spalling is recommended for 4 or more pass heaters. Steam spalling is not suitable for 2 pass heaters as large amount steam will go into coke drum causing process problems in the downstream fracionator.

Steam-Air Decoking: In this method, the heater is taken off-line and then steam-spalled first as described above. Steam spalling will remove majority of coke. Then small amount of coke left on the inside of tube walls is burned off by steam-air decoking.

Pigging: In this method, the heater is taken off-line and then steam-spalled first as described above. Steam spalling will remove majority of coke. The small amount of coke left on the inside of tube walls is scraped with Styrofoam pigs pushed by water pressure. Styrofoam pig is equipped with studs and grit on the external surface.

Today with most of the heaters being 4-pass designs, on-line spalling of one pass is done while other 3 passes continue to produce. The run length of any pass will decrease with each steam-spalling. For example at start of run (clean pass) run length may be 2 months but each successive run length will be lower and lower until last run length may be in days when pigging will need to be done to clean the pass (usually the whole heater) completely. Refineries report pigging being required in two to three years.

An industrial delayed coker feed heater is presented in FIG. 1. The delayed coker feed heater is divided into two sections namely radiant and convection sections. Radiant section contains a bank of tubes termed as radiant coils, heated by firing fuel on the outside to achieve desired coil outlet temperature for a given residue feed. The technology has evolved such that a small amount of steam (called velocity steam) is injected as boiler feed water in the radiant coil to increase the velocity of hydrocarbon through radiant tubes to prevent excessive coking Residue feed is heated in the convection section and enters radiant section at an incipient cracking temperature and exits at the predetermined coil outlet temperature usually between 925 to 950° F. Flue gases from the radiant section exit to convection section where the heat contained in the flue gases is primarily used to heat residue feed to incipient reaction temperature and balance is used to generate utility steam. Obviously incipient reaction temperature and coil outlet temperature varies with residue type and desired yield of products. During production, coke is formed on the inside of radiant tube walls. The thickness of coke formed is higher at the coil outlet than it is at the radiant coil inlet from convection section.

In order to prepare one pass of the delayed coker feed heater for decoking with on-line spalling method, valve $F_1$ is closed and valve $W_1$ is opened so that residue feed is cut off and boiler feed water is introduced. Boiler feed water converted to steam and heated to coil outlet temperature of about 1200° F. goes to the coke drum which is under production by receiving residue from other passes. After maintaining the pass at around 1200° F. (from 12 to 30 hours) firing is suddenly reduced to cool radiant tubes to temperature 800 to 1000° F. to induce spalling of coke from radiant tube walls. Steam flow is maintained so that spalled coke goes into coke drum.

In the on-line steam spalling, coil outlet temperature is maintained at around 1200° F. and steam entering radiant tubes from the convection section is at much lower temperature around 600° F. At these low temperatures steam cannot burn or gasify coke. However by injecting proper mixture of chemicals coke can be gasified at temperatures as low as 650° F. Obviously coke gasification rate increases with operating temperature.

Refining industry would greatly benefit if on-line chemical-steam decoking is used in the delayed coker feed heaters. In chemical-steam decoking water gas reaction takes place to gasify coke. Water gas reaction is endothermic which does not cause hot spots in the radiant coil. Accelerating water gas reaction to gasify coal or coke is probably the most investigated subject matter. Application of chemicals to gasify coke in ethylene radiant tubes (thermal cracking of hydrocarbons) has also been tried. For example, Kohfeldt and Herbert in U.S. Pat. No. 2,893,941 in year 1959 proposed injecting aqueous solution of $K_2CO_3$ into gas oil and steam mixture being cracked in ethylene furnaces. Coke produced by gas oil cracking (to produce ethylene) in radiant coils, will gasify by $K_2CO_3$. Kohfeldt and Herbert reported success in extending ethylene furnace run length. Kohfeldt and Herbert also observed that $K_2CO_3$ reduced coking in convection section banks which were operating at temperatures less than 700° F. Recently Gandman in U.S. Pat. No. 6,228,253 proposed injecting aqueous mixture of potassium carbonate and magnesium acetate in ethylene furnace radiant coil or coils where steam decoking effluent along with cracked effluents from other coils were routed to recovery area similar to Kohfeldt and Herbert. Gandman reported success in removing coke from the selected radiant coils. Stancato and DeHaan in 2001 reported at the Ethylene Producers Conference, that rate of gasification of coke by $K_2CO_3$ is 16 times the rate of gasification by steam alone.

Main products of water gas reaction in decoking are CO and $H_2$ with a small quantity of $CO_2$. In the delayed coker process CO, $H_2$ and $CO_2$ are produced in normal production. Thus when one pass of the heater is under decoking the products of decoking are not harmful to the primary products in other passes going to the Coke Drum.

Success of applying chemical-steam gasification to Delayed Coking feed heater depend on proper marriage of steam decoking process parameters such as steam flow rate and coil outlet temperature with chemical injection rate.

Patents and literature are full of many investigations of chemicals used in accelerating water-gas reaction. We researched literature to find another reasonably priced chemical which can provide synergy with $K_2CO_3$. In a comprehensive review of carbon gasification, Nand (1981) in his thesis refers work of Kayembe and Pulsifier (1976) who found that the highest steam gasification rates were achieved by $K_2CO_3$ and KOH.

SUMMARY OF THE INVENTION

The present invention accelerates the speed of coke gasification by steam with the help of a chemical mixture of KOH and $K_2CO_3$. Optimum combination of steam flow rate, coil outlet temperature and chemical mixture injection rates are required for this method to complete decoking in the same or better time frame than that required by on-line steam spalling of delayed coker feed heater. Chemical assisted steam decoking is terminated when CO content in the heater effluent is less than 0.1 mole % on dry basis or the steam pressure drop comes to a low constant value.

Major advantages of the method of the present invention are an efficient and non-aggressive method of decoking which can result in longer radiant coil life, relatively constant heater run lengths throughout the coil life. There are other advantages of this method which will be apparent to those skilled in the art based upon the description of preferred embodiments described.

Additionally, a heater which is decoked using this method would be able to crack residue with the chemical mixture at levels of 10 to 50 ppmw on feed to gasify coke formed during production thereby extending heater run length.

BRIEF DESCRIPTION OF THE DRAWINGS

For a detailed description of the preferred embodiment of the invention, reference will now be made to the accompanying drawings wherein:

FIG. 1 is a schematic of a typical delayed coker feed heater.

DETAILED DESCRIPTION OF THE INVENTION

Referring now to FIG. 1, there is shown a schematic of a typical delayed coker feed heater. A delayed coker feed heater consists of a radiant section and a convection section which usually sits on the top of the radiant section. The radiant section is where heat for the process is provided by firing fuel. Flue gases exiting the radiant section are sent to the convection section to recover heat. The radiant section contains a number of horizontal radiant tubes where partial residue thermal cracking takes place. The convection section contains a few of tube banks with each bank having a specific heat recovery function. Typically the top bank in the convection section heats boiler feed water which is sent to the steam drum located in the heater structure. The second bank from the top superheats saturated steam coming from the steam drum. The bottom bank in the convection section heats the residue feed to incipient cracking temperature around 700° F. which is called cross over temperature (XOT). Residue at cross over temperature enters radiant section where partial thermal cracking occurs. The technology has evolved such that a small amount of steam (called velocity steam) is injected as boiler feed water in the radiant coil to increase the velocity of hydrocarbon through radiant tubes to prevent excessive coking Partially cracked residue and steam mixture from radiant coils is sent to "Coke Drum" mounted on the top of the structure. Usually there are two coke drums with one in operation and other being emptied of coke. Metal temperature of $2^{nd}$ or $3^{rd}$ row from the bottom of the heater is used to control firing. The convection section banks could be designed for different services.

FIG. 1 also shows key valving configurations. The bottom bank (used for heating residue to cross over temperature) has eight valves: feed valves $F_1$ to $F_4$ and boiler feed water valves $W_1$ to $W_4$. Each pass has a feed valve and a boiler feed water valve. Valves $F_1$ to $F_4$ are open normally in production mode while valves $W_1$ to $W_4$ are closed. Residue flows through Bank 3 in four parallel passes via valves $F_1$ to $F_4$ and enters the radiant section. Residue heated to about 925 to 950° F. is combined from all passes and enters a "Coke Drum" located at the top of a separate structure. When one coke drum is full the process is directed to the second coke drum. The first coke drum is then isolated from heater and coke is removed from it. Coke from coke drum is dropped into a hopper at the bottom.

During decoking of a pass (say pass 1) feed valve $F_1$ is closed and boiler feed water valve $W_1$ is opened. Boiler feed water is heated/vaporized and maintained at heater outlet temperature of 1200° F. by controlled firing.

Present invention addresses a very critical step of decoking of the delayed coker feed heater. A separate connection with Valve $C_1$ is made to the feed line where a predetermined amount of chemical mixture is injected into boiler feed water during decoking We will call this method as steam-chemical method of decoking delayed coker feed heater. The mixture of steam (from boiler feed water) and chemicals along with products of coke gasification will mix with heated residue from other 3 passes and go to coke drum. Steam-chemical decoking may take 24 to 48 hours. Methodology of steam-chemical decoking depends directly on the amount of coke to be removed from the heater pass under decoking. The amount of coke to be removed in a heater pass is a function of the type of hydrocarbon feed, pass outlet temperature during operation and heater pass run length. The following description of the decoking process is applicable to any delayed coker feed heater. Typical steam-chemical decoke operating process parameters are given in Examples 1 below.

First step in this methodology is to calculate amount of coke that has been deposited in the heater pass during the entire run. The amount of coke lay down in heater tubes is calculated using hydrocarbon feed type, hydrocarbon feed rate to the furnace, radiant tube outlet temperature (COT) and number of days heater pass was on-line (heater pass run length).

Theoretical amount of decoke steam (as boiler feed water injection) required for the water-gas reaction can be calculated for the amount of coke deposited in the furnace. Actual amount of steam is a multiple of theoretical amount of steam. Then hourly decoke steam flow rate is the amount of actual steam divided by the number of hours planned for decoke. However, the maximum hourly decoke steam flow rate should not exceed mass velocity of 60 lbs/ft$^2$-sec.

The coil outlet temperature used in steam-chemical decoke should be in the range of 1100 to 1200° F. and preferably 1200° F. at all times.

The chemical mixture to be injected consists of an aqueous solution of potassium hydroxide (KOH) and potassium carbonate (K2CO3). Aqueous solution should have concentration of no more than 10 wt %, preferably 2 wt %. The amount of potassium hydroxide (KOH) in the potassium hydroxide (KOH)-potassium carbonate (K2CO3) mixture could range from 0 to 50 wt %, normally 10%. Chemicals to be used are not limited to these two compounds as many more choices are available. For example, other hydroxides of group 1 or group 2 metals may be used instead of potassium hydroxide. LiOH is an example of such hydroxide.

The heater pass is now ready for decoking with chemical injection. Valve $C_1$ is opened and aqueous solution of potassium hydroxide (KOH) and potassium carbonate (K2CO3) is injected. Rate of aqueous solution of potassium hydroxide (KOH) and potassium carbonate (K2CO3) injection via valve $C_1$ is predetermined and ranges from 50 ppmw to 1000 ppmw, preferable 500 ppmw, based on the total decoke steam flow rate.

About 70% of the planned decoke time is performed at fixed conditions of decoked steam flow, coil outlet temperature and chemical injection rate. This decoking period removes majority of coke in radiant coils. To remove last traces of coke, decoke steam flow rate is reduced in two steps to provide somewhat longer reaction time for steam and chemical to react with coke. For the next one third (15%) period, decoke steam flow rate is reduced to 90% of the normal decoke steam flow rate. For the last one third (15%) period decoke steam flow rate is reduced 80% of the normal decoke steam flow rate. During the last 30% period, decoke effluent CO concentration will be less than 0.1 mole % on dry basis. In the last 15% period pressure drop in the heater tube pass will be constant which will be an indication to terminate decoking.

After decoking is finished heater pass Valves $W_1$ and $C_1$ will be closed and Valve $F_1$ will be opened to introduce residue feed for production.

Above description of preferred embodiments provides process parameters for steam-chemical decoke method, i.e. decoke steam flow rate, coil outlet temperature and chemical injection rate. Those skilled in the art will recognize that the preferred embodiment of invention described herein and the decoke process parameters derived can be applied to all furnaces. Those skilled in the art can easily develop decoke process parameter matrix as described in the description of the preferred embodiments above. Finally those skilled in the art can use the teaching to adjust the steam-chemical decoke process parameters to achieve best decoking possible for their furnaces. The following example further illustrates the invention but is not to be construed as limitations on the scope of the process and apparatus contemplated herein.

Example 1 provided below describes steam-chemical decoking process as can be performed in any delayed coker feed heater. The steam-chemical decoking process is a modification of the old on-line steam spalling decoking process to reflect water-gas reaction synergy provided by the chemical mixture.

EXAMPLE 1

All the following steps are summarized in the Table 1 below. Delayed coker feed heater is operating at about 950° F. The heater pass 1 is ready for decoking Based on heater pass run length, residue type coke calculation showed a need to decoke the heater pass using a decoke steam (injected as boiler feed water) flow rate of 4,500 lbs/hr. Decoke steam flow rate was equivalent to mass velocity of about 20 lbs/ft$^2$-sec. Mechanical design of the furnace dictated that the coil operating temperature should be limited to about 1200° F. during decoking phase.

Heater pass operation is changed to run in decoke mode by closing valve $F_1$. Then valve $W_1$ is opened and 2,250 lbs/hr of steam is admitted. The fuel firing is continually adjusted to maintain COT of 1200° F. Increase the boiler feed water rate to 4,500 lbs/hr maintaining COT at 1200° F.

Decoking Step 1: Decoking starts when aqueous chemical solution is injected by opening the valve $C_1$. Chemical injection rate is 500 ppmw based on total decoke steam flow rate of 4,500 lbs/hr. Decoke Step 1 has duration of 25 hours. Significant amount of decoking will be finished in this step. Decoke effluent should have CO content of less than 1.0 mole % on dry basis.

Decoking Step 2: Heater decoking is continued with lower decoke steam flow rate of 4,050 lbs/hr and COT of 1200° F. Step 2 has duration of about 5.5 hours. This is to provide longer reaction time in colder parts of the heater such as near cross over. Heater firing is controlled so that COT is maintained at 1200° F. Decoke effluent CO content will reduce to less than 0.1 mole % on dry basis.

Decoking Step 3: Heater decoking is continued with lower decoke steam flow rate of 3,600 lbs/hr and COT of 1200° F. Again the lower steam flow rate will provide longer reaction time in colder parts of the heater. By now pressure drop across the heater pass will stabilize which is an indication of decoke termination.

Heater pass decoking is now complete and the heater pass can be put into production by closing valves $W_1$ and $C_1$ and opening valve $F_1$.

TABLE 1

Decoking Process Parameters for a Heater Pass

| Phase | Note | Step | Duration hours | Cumulative Hours | Decoke steam lbs/h | Chemical Injection ppmw | COT ° F. | Valve $F_1$ | Valve $W_1$ | Valve $C_1$ |
|---|---|---|---|---|---|---|---|---|---|---|
| Cracking | | | | | 0 | | 950 | open | closed | closed |
| Decoking | a | 1 | 25 | | 4500 | | 1200 | open | closed | closed |
| Decoking | b | 2 | 5.5 | 30.5 | 4,050 | 500 | 1200 | closed | open | open |
| Decoking | c | 3 | 5.5 | 36 | 3,600 | 500 | 1200 | closed | open | open |
| Cracking | d | | | | 0 | | 950 | open | closed | closed |

Notes a) Rate of change of COT should be 200° F. per hour b) Inject chemical only after valve F1 is completely closed c) Reduce decoke steam flow rate slowly while maintaining COT of 1200° F.

d) Reduce decoke steam flow rate slowly while maintaining COT of 1200° F.

e) Control firing to lower COT at the rate of 200° F. per hour.

It should be understood that the preferred embodiments of the invention as described in the Example 1 is not intended to limit the invention and parameters describe the preferred embodiments of the invention. While specific embodiments of the present invention have been described above, one skilled in the art will recognize that numerous variations or changes may be made to the process described above without departing from the scope of the invention as noted in the appended claims.

What is claimed is:

1. A process for decoking a delayed coker feed heater comprising the steps of:

(a) supplying a mixture of steam and predetermined chemical amount at pre-calculated radiant coil outlet temperature by controlling heater firing;

(b) decreasing the flow of steam and while maintaining radiant coil temperature and chemical injection rate; and (c) further decreasing the flow of steam while maintaining radiant coil temperature and chemical injection rate until heater de-coking is complete.

2. The process of claim 1, further comprising the steps of:

calculating quantity of steam and chemical mixture to provide sufficient reaction time in the heater as a function of radiant coil outlet temperature; and determining feasible operating radiant coil temperature for decoking.

3. The process of claim 2, further comprising the step of adjusting chemical injection rate into steam to increase coke burning gasification rate.

4. The process of claim 1, wherein in the step (a) the radiant coil outlet temperature is about 1100° F. to 1200° F., depending on the heater mechanical design, and in the step (b) and step (c) the radiant coil temperature is same as that in step (a).

5. The process of claim 1, wherein in the step (a) the steam flow rate in the radiant coils has a mass velocity less than 60 lbs/ft$^2$-sec.

6. The process of claim 1, wherein in the step (a), step (b) and step (c), the chemical mixture is an aqueous solution of KOH and of K2CO3.

7. The process of claim 1, wherein in the step (a), step (b) and step (c), the chemical is an aqueous solution that contains KOH—K2CO3 mixture and the amount of up to 50 wt % KOH.

8. The process of claim 1, wherein in the step (b), step (b) and step (c) chemical injection rate provides from 10 to 1000 ppmw chemical mixture based on steam flow rate.

9. The process according to claim 1, wherein in the step (a), step (b) and step (c), the chemical contains a hydroxide of a metal selected from group 1 or group 2 of the periodic table.

10. The process according to claim 9, wherein the metal hydroxide is selected from the group of KOH or LiOH.

11. A method of decoking a delayed coker feed heater, comprising the steps of:

maintaining a temperature suitable for allowing the gasification of coke;

contacting the heater with steam and a mixture of a metal hydroxide and a metal carbonate; and decreasing the flow of steam and while maintaining radiant coil temperature and chemical injection rate.

12. The method according to claim 11 wherein the metal that is present in the metal hydroxide or in the metal carbonate is a metal from group 1 (Li, Na, K, Rb, Cs or Fr) or group 2 (Be, Mg, Ca, Sr, Ba or Ra) of the periodic table.

13. A method according to claim 11 wherein the step of contacting the furnace with steam and a mixture of a metal hydroxide and a metal carbonate is carried out for a time which is sufficient to remove the coke from the furnace.

* * * * *